US005382144A

United States Patent [19]

Tanaka et al.

[11] Patent Number: 5,382,144

[45] Date of Patent: Jan. 17, 1995

[54] OLDHAM RING OF SCROLL TYPE COMPRESSOR

[75] Inventors: Tadashi Tanaka, Konan; Masaaki Sakamoto, Nagoya; Tohru Kato, Seto; Yoshiaki Sato, Gifu, all of Japan

[73] Assignee: Daido Metal Company Ltd., Nagoya, Japan

[21] Appl. No.: 182,556

[22] Filed: Jan. 18, 1994

[30] Foreign Application Priority Data

Feb. 23, 1993 [JP] Japan ..... 5-033097

[51] Int. Cl.[6] ..... F04C 18/02

[52] U.S. Cl. ..... 418/55.3; 418/178; 418/179; 428/658

[58] Field of Search ..... 418/55.3, 178, 179; 428/650, 658, 680

[56] References Cited

U.S. PATENT DOCUMENTS 4,407,900 10/1983 Kirihara et al. ..... 428/658
5,246,786 9/1993 Usui ..... 428/658

FOREIGN PATENT DOCUMENTS 1237376 9/1989 Japan .
3236268 10/1991 Japan .
493780 8/1992 Japan .
5005494 1/1993 Japan ..... 418/55.3

*Primary Examiner*—Richard A. Bertsch
*Assistant Examiner*—Charles G. Freay
*Attorney, Agent, or Firm*—Browdy and Neimark

[57] ABSTRACT

Wear resistance, seizure resistance, durability and corrosion resistance of an Oldham ring made of an aluminum alloy engaging with a swivel scroll made of an aluminum alloy are improved. The Oldham ring comprises a substrate made of an Al—Si alloy which has a light weight and a high strength, a bond layer of a multiplex zinc base alloy containing Cu and Ni as a primary plating layer which is formed on the substrate, and an electroless Ni—P plating layer having a hardness of MHV550 which is formed on the outermost surface of the Oldham ring.

8 Claims, 3 Drawing Sheets

OLDHAM RING OF SCROLL TYPE COMPRESSOR

BACKGROUND OF THE INVENTION

The present invention relates to a scroll type compressor applied to a coolant compressor of a freezer, an air conditioner or the like and, more particularly, to weight reduction of an Oldham ring and improvement of wear resistance of its sliding surface.

A swivel scroll which is a movable member in a scroll type compressor, and an Oldham ring serving to prevent the swivel scroll from revolving on its own axis, are generally made of cast iron or steel.

However, the operation at a higher speed has been achieved in accordance with a recent progress in the inverter driving technique, and it has been hoped eagerly to reduce the weights of the swivel scroll and the Oldham ring which are movable members, in order to decrease the centrifugal stress and the acceleration stress. Weight reduction of such members has been realized by making a swivel scroll and an Oldham ring of an aluminum alloy and subjecting the sliding surfaces of these two members to electroless Ni plating, as disclosed in JP-A-1-237376, or by adopting a dipping method so that the sliding surface of an Oldham ring made of an aluminum alloy is formed of a different metal plate, as disclosed in Japanese Patent Application No. 03-236268. Moreover, there have been proposed an Oldham ring whose sliding surface is coated with iron or an iron base alloy by thermal spray and an Oldham ring whose sliding surface is coated by electroless Ni—P plating.

In the example of the conventional technique in which both a swivel scroll and an Oldham ring are formed of an aluminum alloy, abnormal wear caused by seizure, scuffing or the like owing to the sliding contact between aluminum members which is a contact between members of the same kind of metal, and corrosion resistance are matters to be considered. The example in which the sliding surface of an Oldham ring is coated with iron or an iron base alloy by thermal spray encounters problems such as deterioration of the precision of parts caused as a result of the thermal-spray coating treatment, and additional cost resulting from the surface treatment. Further, in the example in which the sliding surface of an Oldham ring is subjected to electroless Ni—P plating in accordance with the conventional method, bonding strength between the Oldham ring and the Ni—P plating is not satisfactorily high, which results in a problem of local separation of the plating. Also, since the micro-Vickers hardness of the Ni—P plating formed by the conventional method is 500 or less, the thickness of the plating must be increased to some extent in consideration of wear resistance at the time of sliding movement. Therefore, when the plating thickness is increased, uniformity in the plating thickness is deteriorated to cause partial contact between the Oldham ring and the associated member, which results in abnormal wear and abnormal seizure.

The present invention has been achieved in such a technical background, and it is an object of the invention to solve the above-described problems and to provide an Oldham ring of a scroll type compressor which is excellent in wear resistance, seizure resistance and durability which particularly matter at the time of high-speed operation.

SUMMARY OF THE INVENTION

According to the present invention in order to attain this object, the following Oldham ring is provided.

An Oldham ring of a scroll type compressor, which is in an engagement relationship with a swivel scroll to restrain its free rotational movement, and is made of an aluminum alloy, the Oldham ring including a bond layer of a multiplex zinc base alloy containing Cu and Ni and having a thickness of 0.05 to 0.5 μm as a primary plating layer which is formed at least on the surface in sliding contact with the swivel scroll, and an electroless Ni—P plating layer having a thickness of 3 to 15 μm and a micro-Vickers hardness of 550 or greater which is formed on the bond layer.

As the multiplex zinc base alloy for the bond layer, an alloy essentially consisting of, by weight, 6 to 10% Cu, 4 to 8% Ni, and the balance of Zn and unavoidable impurities is preferably used. Further, the Ni—P plating layer preferably has a composition essentially consisting of, by weight, 6 to 13% P (phosphorus), and the balance of Ni.

As the aluminum alloy which forms the Oldham ring, an Al—Si alloy of a hypo-eutectic structure or a hyper-eutectic structure containing 6.5 weight % or more Si is preferably used. Due to the existence of the bond layer of the multiplex zinc base alloy, an excellent fatigue resistance of the Ni—P plating layer and an excellent bonding property of the Ni—P layer on the aluminum alloy can be obtained.

In the Oldham ring of the scroll type compressor according to the present invention, reasons for restricting the electroless Ni—P plating layer, the bond layer of the multiplex zinc base alloy, and the Si content of the aluminum alloy which are disclosed in the scope of claim, and their functions and effects will now be described.

(1) Electroless Ni—P plating layer

The electroless Ni—P plating layer is formed on the surface of the Oldham ring in order to avoid abnormal wear caused by seizure, scuffing or the like owing to the contact between aluminum alloy members which is a sliding contact between members of the same kind of metal, and the Ni—P plating layer is excellent in the corrosion resistance and the sliding movement property.

Hardness of the electroless Ni—P plating layer:

Since the Ni—P plating has a property to precipitate and harden by a heat treatment, the hardness can be controlled freely. Utilizing this property, the micro-Vickers hardness can be controlled to be 550 or greater by a heat treatment at a temperature of, for example, 200° C. or more, and consequently, an improvement of the wear resistance by a large degree is observed. If the micro-Vickers hardness is smaller than 550, the wear resistance (durability) is insufficient.

Thickness of the electroless Ni—P plating layer:

As the thickness of the plating layer is larger, the durability against wear is physically lengthened. However, when the plating layer thickness is too large, uniformity in the thickness is degraded to cause a partial contact, so that abnormal wear and abnormal seizure tend to occur. Normally, when the thickness is more than 15 μm, uniformity in the plating layer thickness is degraded. In the present invention, however, since the micro-Vickers hardness of the plating layer is set at 550 or greater, the wear resistance is so excellent that a plating layer thickness of more than 15 μm is not required. If the plating layer thickness is less than 3 μm, the wear durability is insufficient.

The phosphorus content in the Ni—P plating layer (6 to 13%):

Phosphorus makes a structure of the Ni—P plating layer finer to suppress generations of pin holes, cracks and so forth, thereby improving oxidation resistance and corrosion resistance and also improving the levelling property (the layer thickness distribution). When the phosphorus content is less than 6%, little effect is produced, and especially, a sufficient hardness can not be obtained. When the phosphorus content exceeds 13%, the plating becomes brittle, and also, the plating quality is deteriorated. The preferable phosphorus content is 9 to 12%.

(2) Bond layer of the multiplex zinc base alloy formed by plating

The bond layer of the multiplex zinc base alloy formed by plating is an intermediate bond layer for bonding the Ni—P plating layer onto the Oldham ring made of an aluminum alloy. Generally, Zn, Cu or brass (Cu—Zn) is employed for the intermediate bond plating layer. However, Zn is inferior in plating uniformity when it is employed alone, so that it can not completely cover uneven portions generated in a pre-treatment, and that the bonding closeness in those portions will be accordingly degraded. Therefore, Zn is not suitable for the intermediate bond layer of the Oldham ring serving as a sliding member. On the other hand, although Cu and brass are excellent in the bonding closeness, they are inferior in corrosion resistance and unpractical when they constitute a local battery with the aluminum alloy. As a result of experiments, the inventors of the present application found that it is possible to obtain an intermediate bond layer which has a fine structure and is excellent in precipitation uniformity by adding Ni to brass. By use of this multiplex zinc base alloy (Zn—Cu—Ni) for the bond layer, the surface of the aluminum alloy base which has been roughened in the pre-treatment can be uniformly coated. Moreover, although it is a ternary alloy, Cu, Zn and Ni precipitate on the aluminum alloy base in this order, and consequently, the proportion of Ni on the outermost surface becomes high. Thus, the bond layer of the multiplex zinc base alloy has an excellent affinity with the Ni—P plating layer and a favorable bonding property. Moreover, in this multiplex alloy plating bath, the Oldham ring is not easily affected by impurities in molten metal for plating, and is hardly deteriorated by impurities in the bath. Therefore, the multiplex alloy plating bath is highly economical in the performance of the plating bath.

The appropriate Cu content in the multiplex zinc base alloy for forming the bond layer is 6 to 10%. The reason is that when the Cu content is less than 6%, a plating precipitation structure of Ni is coarsened, so that the fineness of the structure is deteriorated, and that the bonding closeness is decreased. When the Cu content is more than 10%, corrosion resistance of the bond plating layer is deteriorated, and the bonding closeness with respect to the base aluminum alloy is decreased.

The appropriate Ni content in the multiplex zinc base alloy is 4 to 8%. The reason is that when the Ni content is less than 4%, the corrosion resistance is deteriorated, and also, the bonding closeness is decreased.

When the Ni content exceeds 8%, precipitates of Ni is coarsened, thereby deteriorating the bonding closeness.

(3) Composition of the aluminum alloy for the Oldham ring (Si: 6.5% or more)

Considering the function, property, structure and so forth as the Oldham ring, and further, taking the low thermal expansion, heat treatment freedom, moldability and strength of the aluminum alloy into account, the Si content must be 6.5% or more. Preferably, it is 8 to 18%.

DETAILED DESCRIPTION OF THE PREFERRED EMBODIMENTS

Operating portions of a scroll type compressor whose mechanism itself is publicly known will be hereinafter described briefly with reference to the attached drawings.

Figure 1:
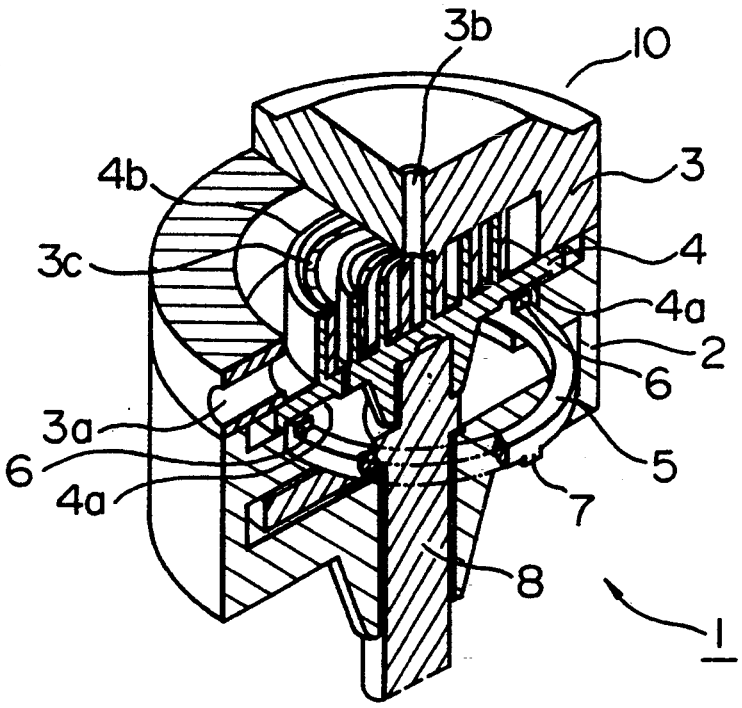
FIG. 1 is a partially broken-away, perspective view showing an essential portion of a scroll type compressor.
Figure 2:
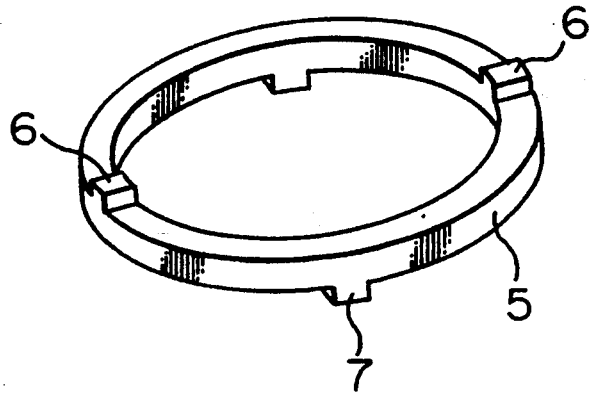
FIG. 2 is a perspective view showing an Oldham ring according to one embodiment of the present invention.
Figure 3:
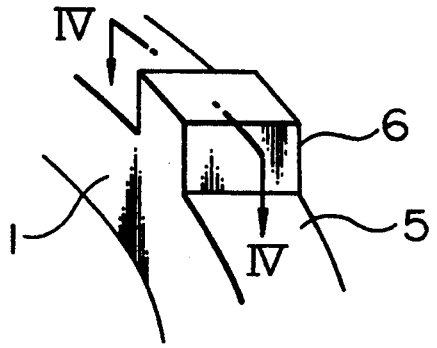
FIG. 3 is a perspective view showing an essential portion of the Oldham ring shown in FIG. 2.

FIG. 1 shows an essential portion of a scroll type compressor 1. The compressor 1 comprises a frame 2, a fixed scroll 3, a swivel scroll 4 made of an aluminum alloy, an Oldham ring 5 made of an aluminum alloy and a crankshaft 8. An upper end portion of the crankshaft 8 (the upper end portion as viewed in FIG. 1) is connected to a central portion of a base plate of the swivel scroll 4 in such a manner as not to rotate relatively. An upper-end crank portion of the crankshaft 8 moves eccentrically in accordance with rotation of the crankshaft, and a volute vane **4*b* of the swivel scroll 4 thus driven is brought into contact with a volute vane 3*c* of the fixed scroll 3 in a particular relationship. Due to this relationship of the contact, coolant gas is drawn into a suction gas chamber through a suction port 3*a* formed in the fixed scroll 3, and after being compressed between the two vanes, it is discharged through a discharge port 3*b* formed in the fixed scroll 3**.

The Oldham ring 5 has a pair of projections 6 which project from the upper surface and a pair of projections 7 which project from the lower surface. The pair of projections 6 are located on a first straight line passing the axis of the circular Oldham ring 5, and the pair of projections 7 are located on a second straight line passing the axis of the Oldham ring 5 and extending in parallel to a straight line perpendicular to the first straight line. Further, the pair of projections 6 are engaged in a pair of grooves **4*a* formed in the base plate of the swivel scroll 4, and the pair of projections 7 are engaged in a pair of grooves formed in a member on the frame 2** side although not shown.

A special movement of the swivel scroll 4 is obtained from an engagement relationship with the Oldham ring 5. More specifically, the Oldham ring 5 moves only in a direction along the second straight line passing the pair of projections 7 while being restrained from rotating due to an engagement relationship between the projections 7 and the member on the frame 2 side. Consequently, the swivel scroll 4 can move along with the Oldham ring 5 in the direction of the second straight line due to an engagement relationship between the projections 6 and the grooves 4a. On the other hand, the engagement relationship between the projections 6 and the grooves 4a allows the swivel scroll 4 to move in a direction along the first straight line. Thus, the swivel scroll performs a composite movement comprising a movement of the Oldham ring in the direction along the second straight line and a movement of the swivel scroll itself in the direction along the first straight line extending perpendicular to the second straight line.

Figure 4:
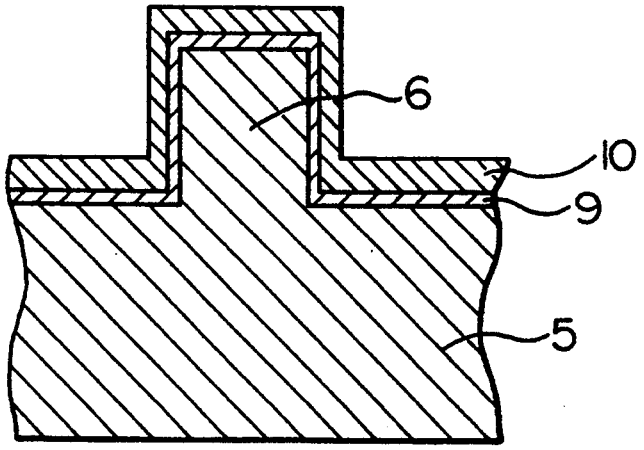
FIG. 4 is a cross-sectional view taken along the line IV—IV of FIG. 3.

It can be understood from the above description that the projecting portions of the Oldham ring 5 are in sliding contact with the swivel scroll and the member on the frame 2 side. Therefore, at least the surface of the Oldham ring 5 which is in sliding contact with the other component is subjected to a surface treatment. FIG. 4 shows a result of the surface treatment. More specifically, a bond layer 9 of a multiplex zinc base alloy containing Cu and Ni is formed on the Oldham ring as a primary plating layer, and an electroless Ni—P plating layer 10 is formed thereon.

EXAMPLE

Sliding properties (wear resistance) which is an important factor for movable members such as a swivel scroll and an Oldham ring were investigated. As a test sample of the present invention, an underlayer (bond layer) of a multiplex zinc base alloy, and an overlay of an electroless Ni—P plating layer having a thickness of 10 μm were formed in order on the surface of an Al alloy sheet (JIS ADC12), and the test sample was thereafter subjected to a heat treatment (250° C.×1 hour) so that the electroless Ni—P plating layer have a hardness of MHV600. Further, a non-treated Al alloy sheet (JIS ADC12) and a surface-treated Al alloy sheet (JIS ADC12) were prepared. The latter was prepared by forming an electroless Ni—P plating layer having a thickness of 25 μm on the surface of the Al alloy sheet, thereafter, subjected to a heat treatment so that the Ni—P plating layer has a hardness of MHV450. Thus, two kinds of test samples were prepared as conventional materials for comparisons.

Figure 5:
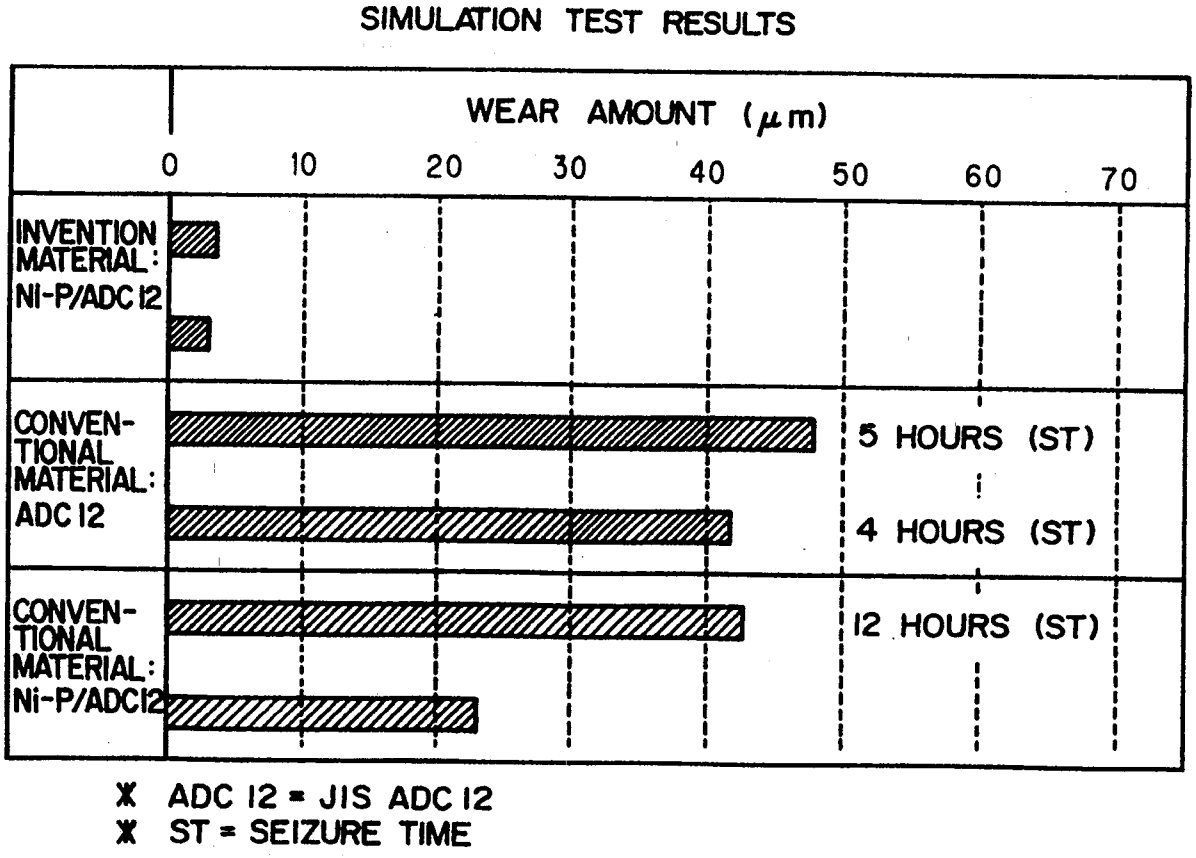
FIG. 5 is a graph showing results of comparative tests for evaluating sliding properties of an aluminum alloy including a coating layer formed by a surface treatment according to the present invention, when it is in sliding contact with another aluminum alloy material.

Tests of the invention material and the conventional materials thus obtained were performed while simulating the sliding movement between the swivel scroll and the Oldham ring. Test conditions are shown in Table 1, and test results are shown in FIG. 5. As obviously understood from the test results of FIG. 5, in either of two tests of the Al alloy sheet (JIS ADC12) which was the unprocessed conventional material and in one of two tests of the Al alloy sheet (JIS ADC12) having the electroless Ni—P plating layer formed on the surface which was the conventional material Ni—P/ADC12, wear reached an aluminum alloy substrate of each sample to bring about seizure, and the Ni—P plating layer was separated in the vicinity of a portion where the seizure had occurred. On the other hand, an amount of wear of the invention material was small, and it goes without saying that separation of the Ni—P plating layer did not occur. It is clear that the invention material has excellent wear and seizure resistances and a favorable bonding property.

The Oldham ring according to the present invention is formed of an Al—Si alloy having a high strength so as to reduce the weight and to decrease the force of inertia. Moreover, a bond layer of a multiplex zinc base alloy which is excellent in bonding closeness with respect to both of the aluminum alloy and an electroless Ni—P plating is formed. An Ni—P plating layer which is fine in structure, hard, and uniform in layer thickness to provide an excellent wear resistance is further formed. Thus avoiding a sliding contact between members of the same aluminum alloy, the functional and structural problems of the Oldham ring can be solved, so that the Oldham ring will fully exhibit an excellent performance even under the severe conditions of recent high-speed revolutions.

TABLE 1

SIMULATION TEST CONDITIONS

| ITEM | CONDITION |
|---|---|
| REVOLUTION | 1500 rpm |
| VELOCITY | 1.93 m/second |
| LUBRICATING METHOD | OIL BATH |
| LUBRICANT OIL TEMPERATURE | ROOM TEMPERATURE (°C.) |
| MATING MEMBER | JIS AC8C |
| SPECIFIC LOAD | CONSTANT LOAD OF 5.9 Mpa |
| TEST DURATION | 20 hours |

What is claimed is:

1. An Oldham ring of a scroll type compressor having a swivel scroll made of an aluminum alloy, which Oldham ring is in an engagement relationship with said swivel scroll to restrain its free rotational movement, and is made of an aluminum alloy, said Oldham ring including a bond layer of a multiplex zinc base alloy containing Cu and Ni and having a thickness of 0.05 to 0.5 μm as a primary plating layer which is formed at least on a surface in sliding contact with said swivel scroll, and an electroless Ni—P plating layer having a thickness of 3 to 15 μm and a micro-Vickers hardness of 550 or greater which is formed on said bond layer, so that the existence of said bond layer of the multiplex zinc base alloy enhances fatigue resistance of said Ni—P plating layer and bonding strength of said Ni—P plating layer on the aluminum alloy.

2. An Oldham ring of a scroll type compressor according to claim 1, wherein said bond layer of the multiplex zinc base alloy essentially consists of, by weight, 6 to 10% Cu, 4 to 8% Ni, and the balance of Zn and unavoidable impurities.

3. An Oldham ring of a scroll type compressor according to claim 1, wherein said Ni—P plating layer essentially consists of, by weight, 6 to 13% P (phosphorus), and the balance of Ni and unavoidable impurities.

4. An Oldham ring of a scroll type compressor according to claim 1, wherein the aluminum alloy which forms said Oldham ring is an Al—Si alloy of a hypo-eutectic structure or a hyper-eutectic structure containing 6.5 weight % or more Si.

5. An Oldham ring of a scroll type compressor according to claim 2, wherein said Ni—P plating layer essentially consists of, by weight, 6 to 13% P (phosphorus), and the balance of Ni and unavoidable impurities.

6. An Oldham ring of a scroll type compressor according to claim 5, wherein the aluminum alloy which forms said Oldham ring is an Al—Si alloy of a hypo-eutectic structure or a hyper-eutectic structure containing 6.5 weight % or more Si.

7. An Oldham ring of a scroll type compressor according to claim 3, wherein the aluminum alloy which forms said Oldham ring is an Al—Si alloy of a hypo-eutectic structure or a hyper-eutectic structure containing 6.5 weight % or more Si.

8. An Oldham ring of a scroll type compressor according to claim 2, wherein the aluminum alloy which forms said Oldham ring is an Al—Si alloy of a hypo-eutectic structure or a hyper-eutectic structure containing 6.5 weight % or more Si.

* * * * *